US007634876B2

(12) United States Patent
Moller, Jr.

(10) Patent No.: US 7,634,876 B2
(45) Date of Patent: Dec. 22, 2009

(54) MODULAR FLOOR LOCATOR APPARATUS

(76) Inventor: Jorgen J. Moller, Jr., 8669 S. Hidden Oaks Cir., Salt Lake City, UT (US) 84121

( * ) Notice: Subject to any disclaimer, the term of this patent is extended or adjusted under 35 U.S.C. 154(b) by 129 days.

(21) Appl. No.: 11/608,549

(22) Filed: Dec. 8, 2006

(65) Prior Publication Data

US 2008/0134593 A1 Jun. 12, 2008

(51) Int. Cl.
*E01C 5/20* (2006.01)
*E01C 5/16* (2006.01)
*B32B 3/00* (2006.01)

(52) U.S. Cl. ..... 52/177; 52/179; 52/588.1; 52/592.1; 52/591.1; 428/156; 428/167; 428/213; 404/35; 404/40

(58) Field of Classification Search ..... 52/589.1, 52/591.1–591.2, 590.1, 590.2, 592.1–592.6, 52/570, 177, 180–181, 403.1, 390, 391, 392, 52/386, 384, 126.2, 578, 581, 663, 588.1, 52/650.3, 747.1, 747.11; 404/35, 40, 41, 404/42; 472/92; 296/37.2; 188/32; 5/417; 428/156, 172, 167, 213, 119, 120, 141, 192
See application file for complete search history.

(56) References Cited

U.S. PATENT DOCUMENTS

| | | | | | |
|---|---|---|---|---|---|
| D28,907 | S | | 6/1898 | Haugh | |
| 738,704 | A | | 9/1903 | Semmer | |
| 1,257,144 | A | * | 2/1918 | Stanwood | 52/177 |
| 1,420,775 | A | | 6/1922 | Stanwood | |
| 1,625,187 | A | | 4/1927 | Birch | |
| D93,991 | S | | 12/1934 | Moore | |
| RE19,518 | E | | 4/1935 | Chaffee | |
| 2,156,777 | A | * | 5/1939 | Duryea | 52/180 |
| 2,287,653 | A | * | 6/1942 | Walker | 404/42 |
| 2,465,551 | A | * | 3/1949 | Otterness | 188/32 |
| 2,746,571 | A | * | 5/1956 | Taylor | 188/32 |
| 3,015,136 | A | | 1/1962 | Doe | |
| 3,077,059 | A | | 2/1963 | Stout | |
| 3,093,870 | A | | 6/1963 | Brock | |
| 3,196,763 | A | | 7/1965 | Rushton | |
| 3,279,138 | A | | 10/1966 | Dittmar | |
| 3,284,819 | A | | 11/1966 | Nissen | |
| 3,308,009 | A | | 3/1967 | Baumgartner Jr. | |
| 3,310,919 | A | | 3/1967 | Bue et al. | |
| 3,319,392 | A | | 5/1967 | Fitzgerald | |

(Continued)

FOREIGN PATENT DOCUMENTS

GB 2262437 A 6/1993

OTHER PUBLICATIONS

Athletic Business, advertisement for Flexideck, p. 81; advertisement for Sport Floor, p. 53; advertisement for Basic Coatings Sports, p. 43, Mar. 2001.

(Continued)

*Primary Examiner*—Jeanette E. Chapman
(74) *Attorney, Agent, or Firm*—Holland & Hart

(57) ABSTRACT

A modular floor apparatus comprising a modular-floor-locator section to be combined with a plurality of modular-floor tiles to form a flooring surface. The modular-floor-locator section may comprise a top surface and a first locator raised surface area formed in the top surface. The first locator raised surface area may be dimensioned to guide positioning of an object on the top surface.

4 Claims, 11 Drawing Sheets

U.S. PATENT DOCUMENTS 3,438,312 A 4/1969 Becker et al.
3,452,497 A 7/1969 Warp
3,579,410 A 5/1971 Barrett
3,717,247 A 2/1973 Moore
3,741,411 A 6/1973 Peacock
3,861,592 A 1/1975 Fisher
3,909,006 A 9/1975 Arbaugh
3,909,996 A 10/1975 Ettinger, Jr. et al.
4,054,987 A 10/1977 Forlenza
4,133,481 A 1/1979 Bennett
4,211,366 A 7/1980 Czamota
4,223,835 A * 9/1980 Witt et al. ..... 238/14
4,226,060 A 10/1980 Sato
4,287,693 A 9/1981 Collette
4,376,595 A * 3/1983 Shaw ..... 404/17
4,436,779 A 3/1984 Menconi et al.
4,468,910 A 9/1984 Morrison
4,497,858 A 2/1985 Dupont et al.
D280,611 S * 9/1985 Nelson ..... D12/217
4,543,765 A 10/1985 Barrett
4,584,221 A 4/1986 Kung
4,648,592 A * 3/1987 Harinishi ..... 472/92
4,697,294 A * 10/1987 Schafer ..... 14/69.5
4,715,743 A 12/1987 Schmanski
4,826,351 A 5/1989 Haberhauer
4,860,510 A * 8/1989 Kotler ..... 52/177
D306,350 S 2/1990 Hardwick et al.
4,911,270 A * 3/1990 Hudson ..... 188/32
4,930,286 A 6/1990 Kotler
5,014,488 A 5/1991 Evangelos et al.
5,033,241 A 7/1991 Max
5,190,799 A 3/1993 Ellingston, III
5,266,378 A * 11/1993 Stephenson et al. ..... 428/156
5,275,502 A 1/1994 Glaza
5,302,049 A 4/1994 Schmanski
5,323,575 A 6/1994 Yeh
5,328,293 A 7/1994 Keefe
5,403,637 A 4/1995 Pickard et al.
5,478,625 A * 12/1995 Wright ..... 428/119
D366,443 S * 1/1996 Bach et al. ..... D12/217
5,527,128 A 6/1996 Rope et al.
5,556,692 A * 9/1996 Zheng ..... 428/156
D376,944 S * 12/1996 Dunn ..... D6/582
5,634,309 A 6/1997 Polen
D382,354 S 8/1997 Engberg
D383,253 S 9/1997 Semenuk
D385,974 S 11/1997 Berger
D385,978 S 11/1997 Berger
5,787,654 A * 8/1998 Drost ..... 52/177
5,791,114 A 8/1998 Mandel
5,807,021 A 9/1998 Aaron
5,815,995 A 10/1998 Adam
D401,210 S * 11/1998 Chiang ..... D12/217
5,833,386 A 11/1998 Rosan et al.
5,948,250 A * 9/1999 Middleton ..... 210/232
5,950,378 A * 9/1999 Council et al. ..... 52/177
D415,471 S 10/1999 Henry
5,992,106 A * 11/1999 Carling et al. ..... 52/177
6,026,625 A 2/2000 Austin
6,061,979 A 5/2000 Johannes
6,098,354 A * 8/2000 Skandis ..... 52/177
6,128,881 A 10/2000 Bue et al.
D433,660 S * 11/2000 Hough ..... D12/217
6,189,283 B1 2/2001 Bentley et al.
6,202,374 B1 * 3/2001 Cooper et al. ..... 52/220.3
6,301,848 B1 * 10/2001 Whitaker ..... 52/302.1
6,344,266 B1 * 2/2002 Potocki ..... 428/304.4
D456,533 S 4/2002 Moller, Jr.
D462,792 S 9/2002 Ogawa
6,467,224 B1 * 10/2002 Bertolini ..... 52/177
6,526,705 B1 3/2003 MacDonald
6,607,627 B2 8/2003 Nelson
D481,470 S 10/2003 Moller, Jr.
6,713,138 B2 * 3/2004 Griner ..... 428/35.7
6,718,588 B1 4/2004 Frederiksen
6,751,912 B2 * 6/2004 Stegner et al. ..... 52/177
6,794,013 B1 * 9/2004 Iacovelli et al. ..... 428/120
6,802,159 B1 * 10/2004 Kotler ..... 52/177
6,849,317 B1 * 2/2005 Oakey et al. ..... 428/88
6,878,430 B2 4/2005 Milewski et al.
6,880,763 B1 * 4/2005 Ford ..... 238/14
6,954,975 B2 10/2005 Dolinski
6,966,155 B2 11/2005 Nevison
D516,737 S 3/2006 Moller, Jr.
7,008,686 B1 * 3/2006 Rogers ..... 428/178
7,021,237 B1 * 4/2006 Benjamin ..... 116/28 R
7,043,792 B2 5/2006 Kessler
D528,707 S * 9/2006 Deioma ..... D30/118
7,114,298 B2 10/2006 Kotler
7,299,592 B2 * 11/2007 Moller, Jr. ..... 52/180
7,316,834 B2 * 1/2008 Hernandez ..... 428/60
7,401,441 B2 * 7/2008 Zimmerle et al. ..... 52/177
2002/0071930 A1 * 6/2002 Oakey et al. ..... 428/85
2002/0119291 A1 8/2002 Hainbach
2002/0157331 A1 * 10/2002 Peart et al. ..... 52/220.2
2004/0093810 A1 * 5/2004 Mooney ..... 52/177
2004/0237426 A1 * 12/2004 Dolinski ..... 52/177
2004/0258869 A1 * 12/2004 Walker ..... 428/44
2005/0055942 A1 * 3/2005 Maelzer et al. ..... 52/578
2005/0066606 A1 * 3/2005 Dolinski ..... 52/582.2
2005/0108968 A1 * 5/2005 Forster ..... 52/578
2005/0193669 A1 * 9/2005 Jenkins et al. ..... 52/392
2005/0200051 A1 9/2005 Ricciardelli et al.
2005/0229520 A1 * 10/2005 Julton ..... 52/443
2005/0252109 A1 * 11/2005 Fuccella et al. ..... 52/177
2006/0016136 A1 * 1/2006 Moller, Jr. ..... 52/177
2006/0070314 A1 * 4/2006 Jenkins et al. ..... 52/177
2006/0260223 A1 * 11/2006 Wang ..... 52/177
2006/0265975 A1 * 11/2006 Geffe ..... 52/177
2006/0272252 A1 * 12/2006 Moller, Jr. ..... 52/384
2006/0283118 A1 * 12/2006 Moller, Jr. ..... 52/403.1
2006/0283125 A1 * 12/2006 Moller, Jr. ..... 52/578
2007/0280782 A1 * 12/2007 Rogers et al. ..... 404/35
2008/0127593 A1 * 6/2008 Janesky ..... 52/581

OTHER PUBLICATIONS

Athletic Business, advertisement for Hid-N-Lok School Color Series tiles; advertisement for Fitness Flooring, p. 29; advertisement for Mitchell Rubber Products, p. 30; advertisement for Loktuff, p. 34; advertisement for Dri-Dek, p. 74, advertisement for Tepromark, p. 77; advertisement forHaro Sports Floors, p. 100; advertisement for Plexipave, p. 127; advertisement for Aacer Flooring, p. 226; advertisement for Spidertile, p. 236; advertisement for Mateflex, p. 259; advertisement for SportCourt, pp. 280-281; Feb. 2004.

Brochure, "It's Not Just a Sports Floor," Sport Court Performance Sports Flooring, date unknown.

A Complete Guide to Sports Surfaces and Flooring, advertisement for Sport Court, p. 5; advertisement for Multi-Play Sports Flooring, p. 9; advertisement for Rubber Products, p. 9; advertisement for SnapCourt Floors, p. 12; advertisement for PlayGuard, p. 15; advertisement for American Sports Builders Associaton, p. 15; advertisement for "Unity" Surfacing Systems, p. 22; advertisement for Dynamic Sports Constructions, Inc., p. 22; advertisement for Versacourt, p. 23; advertisement for Swiss Flex, p. 26; advertisement for SportMaster Sport Surfaces, p. 26; advertisement for Centaur Floor Systems, p. 30; advertisement for All Deck, p. 30; Jul./Aug. 2005.

Program for AVCA 2003 Annual Convention, advertisement for Mateflex, p. 12, Dec. 2003.

Athletic Business, advertisement for Dri-Dek, p. 47; advertisement for Mateflex, p. 97; advertisement for Duragrid, p. 132; advertisement for Kiefer Specialty Flooring, Inc., p. 134, Dec. 2003.

Athletic Business, advertisement for Mateflex, p. 16; advertisement for Aacer Flooring, p. 41; advertisement for Sport Court, p. 50; advertisement for Dri-Dek, p. 83; advertisements for Horner Flooring Co., Kiefer Specialty Flooring, Inc., and Mateflex-Mele Corp., p. 103; advertisements for Oscoda Plastics, Inc. and Primier Tiles, p. 104; advertisements for Spidercourt, Inc., Sport Court, Inc., Sport Floors, Inc., Sporturf, Sprinturf, Sri Sports, Inc., Superior Floor Company, Inc., and Synthetic Surfaces, p. 106; Nov. 2003.

Athletic Business, advertisements for Dri-Dek and Fitness Flooring, p. 77; advertisements for Dri-Dek/Kendall Products and Duragrid, p. 91; advertisement for Mateflex-Mele Corp., p. 94; advertisements for Dri-Dek/Kendall Products, Dodge-Regupol, Inc., p. 104, Jul. 2002.

Athletic Business, advertisement for Dri-Dek, p. 83; Jul. 2004.

Athletic Business, advertisement for Aacer Flooring, p. 10; advertisement for SnapCourt Sports Floor, p. 14; advertisement for Dri-Dek, p. 65; advertisement for Metexlfex, p. 231; advertisement for Sport Court, p. 241-43; advertisements for ProLine SPF and Swiss Flex, p. 245, Feb. 2005.

Athletic Business, advertisement for Dri-Dek, p. 12; advertisement for Mateflex, p. 91; advertisements for Dri-Dek, Everlast Performance Flooring, p. 112; advertisement for Mateflex, p. 115, Aug. 2005.

Athletic Business, advertisement for Mateflex, p. 51; advertisement for Dri-Dek, p. 63; advertisement for Dri-Dek, p. 96, Aug. 2004.

Recreation Management, advertisements for Taraflex Sports Flooring, Aacer Flooring, LLC, Action Floor Systems, Aeson Flooring Systems, Centaur Floor Systems, LLC; Swiss Flex, Sport Court International, p. 217; advertisement for Mitchell Rubber Products, Fitness Flooring, Summit Flexible Products, Premier Court, p. 218; advertisements for Aacer Flooring, p. 221; advertisements for SportMaster Sport Surfaces and Swiss Flex, p. 227; advertisement for Sport Court, p. 229, Dec. 2004.

Grassroots Motor Sports, advertisement for RaceDeck, p. 61; Article, "FLOORED—Two Ways to Make Your Shop Floor Look Beautiful," pp. 125-126, Mar. 2002.

Athletic Business, advertisement for Dri-Dek, p. 55; advertisements for Rubber Products and Multi-Play Sports Flooring, p. 139; advertisement for Fitness Flooring, p. 167; advertisement for Mateflex, p. 233; advertisements for Centaur Floor Systems and Flex Court, p. 250; advertisement for Athletic Surface Systems (Sport Court), p. 281-84, Feb. 2006.

Club Management, advertisement for Duragrid, p. 161; Apr. 2002.

Athletic Business, advertisement for Sport Court, p. 39; advertisement for Dri-Dek, p. 49; advertisement for VersaCourt, p. 93, Sep. 2004.

Recreation Management, advertisement for Sport Court, p. 9; advertisement for Dri-Dek, p. 21, May/Jun. 2005.

Athletic Business, advertisement for Dri-Dek, p. 16; advertisement for SpiderTile, p. 20; advertisement for Mateflex, p. 69; advertisements for Premier Tiles, Prestige Enterprises International, Inc., Rhino Sports, and Robbins Sports Surfaces, p. 139; advertisements for SpiderCourt Inc., Sport Court, Inc. and Sport Floors, Inc., p. 141, Apr. 2003.

Performance Sports Flooring, Sport Court Performance Sports Flooring, book and CD, Jan. 2004.

Advertisement for IceCourt XS, date unknown.

Brochure for Mateflex, 8 pages, date unknown.

* cited by examiner

MODULAR FLOOR LOCATOR APPARATUS

BACKGROUND

Modular floors have traditionally been used for many different purposes, including both aesthetic and utilitarian purposes. For example, modular floors may be installed in garages, vehicle displays, etc. Alternatively, a modular floor may also be used to protect the surface beneath the modular floor from various forms of damage. Modular floors are typically formed from modular-floor tiles, which may comprise individual panels permanently or temporarily placed on the ground. A permanent application may involve adhering the tiles to the floor in some way, whereas a temporary application may simply involve setting the tiles on the floor. Modular-floor tiles are often horizontally interconnected to one another to cover large floor areas such as garages, car show displays, or retail displays.

Once a modular floor is installed, a vehicle may be parked on the modular floor. Careful positioning of the vehicle on the modular floor is often desired. For example, a driver parking a vehicle on a modular floor at a display may desire a certain positioning of the vehicle for aesthetic purposes or may want to allow room for other vehicles. A driver pulling onto a modular floor installed in a garage may want to park in a particular location to leave room for another car. The driver may also want to avoid hitting a back wall of the garage while pulling far enough into the garage to allow the garage door to close. Drivers often rely on an object hanging from a ceiling (e.g., a tennis ball) or markings on a wall to guide their parking efforts. Such solutions may lack effectiveness and may look tacky.

BRIEF SUMMARY

According to certain embodiments, a modular-floor apparatus comprises a modular-floor-locator section to be combined with a plurality of modular-floor tiles to form a flooring surface. The modular-floor-locator section may comprise a top surface and a first locator raised surface area formed in the top surface. The first locator raised surface area may be dimensioned to guide positioning of an object on the top surface.

In some embodiments, the modular-floor-locator section may comprise a first tile, and the top surface may comprise a plate. The plate may be positioned above the first tile. According to at least one embodiment, the modular-floor-locator section comprises a second tile attached to the first tile, and the second tile may be positioned under the plate. The modular-floor-locator section may comprise a second locator raised surface area formed in the plate, and the second locator raised surface area may be positioned over the second tile. The first locator raised surface area may be positioned over the first tile.

In various embodiments, the plate may be attached to the first tile. According to at least one embodiment, a top portion of the first tile may be substantially smooth. The top portion of the first tile may also be attached to the plate with an adhesive material. In some embodiments, the modular-floor-locator section may comprise a pad situated between the plate and the first tile. The first tile may comprise a plastic material, the plate may comprise a metal material, and the pad may comprise a rubber material.

In at least one embodiment, the modular-floor-locator section comprises a second locator raised surface area formed in the top surface. The first and second locator raised surface areas may be dimensioned to be substantially co-planar with adjacent modular-floor tiles, with the first and second locator raised surface areas at least partially defining a recessed portion in the top surface. According to various embodiments, the modular-floor-locator section may comprise a first tile, and the first tile may comprise the top surface.

In some embodiments, the modular-floor-locator section comprises a second locator raised surface area, and the first and second locator raised surface areas are spaced to allow a vehicle tire to rest between the first and second locator raised surface areas. The first locator raised surface area may be a parking guide and the object may be a vehicle. According to various embodiments, the modular-floor-locator section is removably attachable to at least one modular-floor tile in the plurality of modular floor tiles. In various embodiments, the first locator raised surface area comprises a chock. The first locator raised surface area may also comprise an elongate wedge.

According to certain embodiments, a modular floor apparatus may comprise a modular-floor-locator section. The modular-floor-locator section may comprise a connecting member removably attachable to a modular floor, a first tile, and a first locator raised surface area formed in the first tile. In various embodiments, the modular-floor-locator section may further comprise a second tile attached to the first tile and a second locator raised surface area formed in the second tile. The first and second locator raised surface areas may be spaced to allow a vehicle tire to rest between the first and second locator raised surface areas. In various embodiments, the modular-floor-locator section may comprise a second locator raised surface area, and the second locator raised surface area may be formed in the first tile.

According to certain embodiments, a modular-floor apparatus may comprise a modular-floor-locator section to be combined with a plurality of modular-floor tiles to form a flooring surface. The modular-floor-locator section may comprise a first tile, a plate positioned over the first tile, and a first elongate-wedge-shaped parking guide formed in the plate. The modular-floor-locator section may also comprise a second elongate-wedge-shaped parking guide formed in the plate. The first and second elongate-wedge-shaped parking guides may be spaced to allow a vehicle tire to rest between the first and second elongate-wedge-shaped parking guides. In at least one embodiment, the modular-floor apparatus may further comprise a second tile, and the plate may be attached to the first and second tiles. In some embodiments, the modular-floor section may be removably attachable to at least one modular-floor tile in the plurality of modular-floor tiles.

The foregoing and other features, utilities, and advantages of the instant disclosure will be apparent from the following more particular description of preferred embodiments of the instant disclosure as illustrated in the accompanying drawings.

BRIEF DESCRIPTION OF THE DRAWINGS

The accompanying drawings illustrate a number of embodiments of the instant disclosure and are part of the specification. Together with the following description, the drawings demonstrate and explain the principles of the instant disclosure.

DETAILED DESCRIPTION

Figure 1:
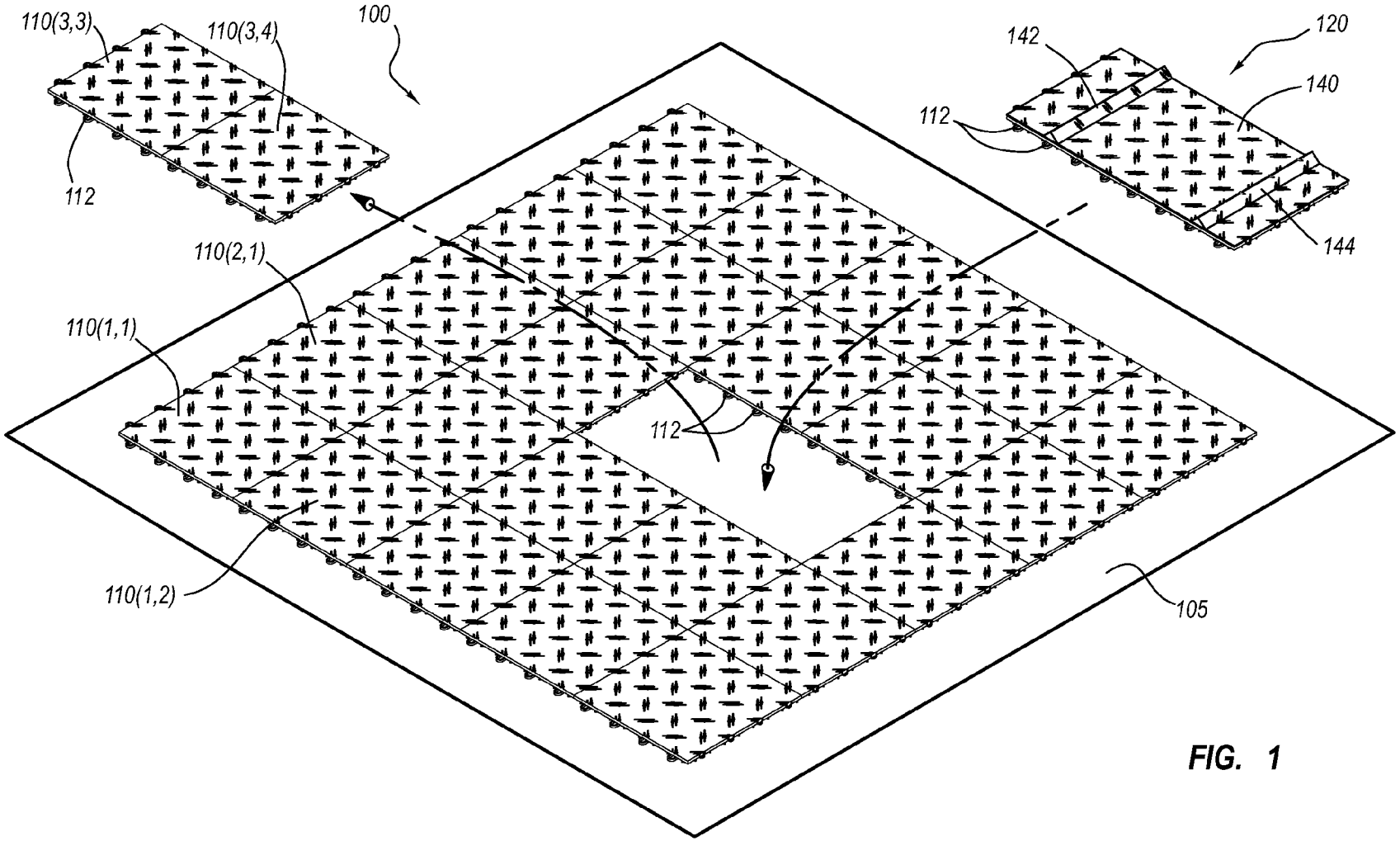
FIG. 1 is a perspective view of an exemplary modular floor according to certain embodiments.

Throughout the drawings, identical reference characters and descriptions indicate similar, but not necessarily identical, elements. While embodiments of the instant disclosure are susceptible to various modifications and alternative forms, specific embodiments have been shown by way of example in the drawings and will be described in detail herein. However, one of skill in the art will understand that embodiments of the instant disclosure are not intended to be limited to the particular forms disclosed herein. Rather, the instant disclosure covers all modifications, equivalents, and alternatives falling within the scope of embodiments defined by the appended claims.

The instant disclosure describes various embodiments of modular floors, modular-floor tiles, and modular-floor sections. The modular-floor tiles and sections may include one or more raised surface areas, which may be in the form of one or more bumps, protrusions, extensions, or other structural forms that can be felt by the driver of a vehicle when positioning the vehicle such that the raised surface areas serve as guides for locating any variety of wheeled vehicles, such as for example cars, trucks, motorcycles, and other vehicles, or even other objects on a modular floor. As these raised surface areas may serve as guides for locating vehicles and/or objects on a modular floor, they may be referred to as locator raised surface areas or modular-floor-locator bumps in some embodiments. Sections or tiles of a modular floor that include locator raised surface areas may be referred to as modular-floor-locator sections according to certain embodiments. As illustrated in the drawings and discussed in the following disclosure, locator raised surface areas and modular-floor-locator sections may be various shapes, sizes, and configurations.

FIG. 1 is a perspective view of an exemplary modular floor 100. Modular floor 100 includes multiple floor tiles 110 that may be placed on a sub-floor 105 (e.g., a concrete garage floor, a show room floor, or any other type of floor). Floor tiles 110 may be hooked together using connecting members 112. For example, floor tile 110(1,2) may be attached to floor tile 110(1,1), floor tile 110(1,1) may be attached to floor tile 110(2,1), etc. Connecting members 112 may be connectors of any shape or size, and any number of connecting members 112 may be included on floor tiles 110. Connecting members 112 may allow floor tiles 110 to snap, hook, latch, or otherwise attach to one another. In some embodiments, floor tiles 110 may not include connectors 112 and may be placed side by side to form modular floor 100 without connecting to one another. Floor tiles 110 may also be secured to sub-floor 105 using an epoxy or any other type of adhesive.

In certain embodiments, floor tiles 110 may be removed from modular floor 100 after modular floor 100 is assembled. For example, FIG. 1 illustrates floor tile 110(3,3) and floor tile 110(3,4) being removed from modular floor 100. Modular-floor-locator section 120 may be installed in the opening left by floor tiles 110(3,3) and 110(3,4). In some embodiments, modular-floor-locator section 120 may be installed as part of the initial installation of modular floor 100.

Modular-floor-locator section 120 may include locator raised surface areas 142 and 144 formed in a top surface 140. As shown in FIG. 1, top surface 140 may be a metal plate. Other materials and configurations for top surfaces of modular-floor-locator sections are presented in FIGS. 4-11. Locator raised surface areas 142 and 144 may be dimensioned as guides or location indicators to assist in positioning an object on the top surface. For example, locator raised surface areas 142 and 144 may be parking guide wedges (e.g., elongate-wedge-shaped parking guides) that help a driver position a vehicle such that a tire of the vehicle rests between locator raised surface areas 142 and 144.

Figure 2:
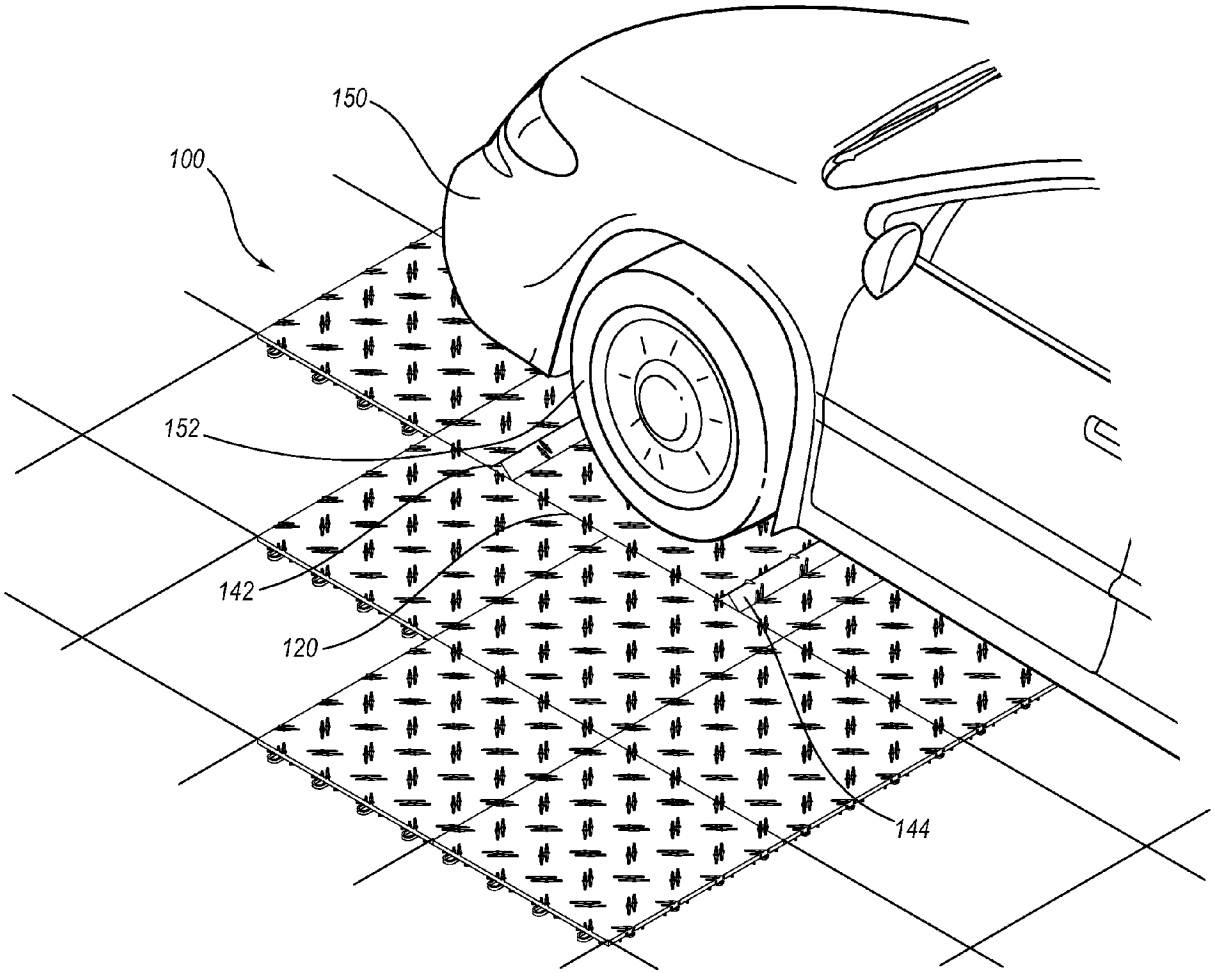
FIG. 2 is a perspective view of a vehicle parked on the exemplary modular floor illustrated in FIG. 1.

FIG. 2 illustrates a perspective view of a vehicle 150 parked on modular floor 100. When a driver pulls vehicle 150 onto modular floor 100, a tire 152 of vehicle 150 may roll over locator raised surface area 144, indicating the vehicle's position to the driver. The driver may then apply the brakes of vehicle 150 to stop tire 152 between locator raised surface area 144 and locator raised surface area 142. The driver may feel when tire 152 comes into contact with locator raised surface area 142, which may indicate that the vehicle is about to be positioned too far forward. Locator raised surface area 142 may also help prevent tire 152 from rolling too far forward. Thus, modular-floor-locator section 120 may help a driver position vehicle 150 on modular floor 100.

Various examples of modular-floor-locator sections, such as modular-floor-locator section 120, fall within the scope of the instant disclosure. Additional examples of modular-floor-locator sections are illustrated in FIGS. 3-11.

Figure 3:
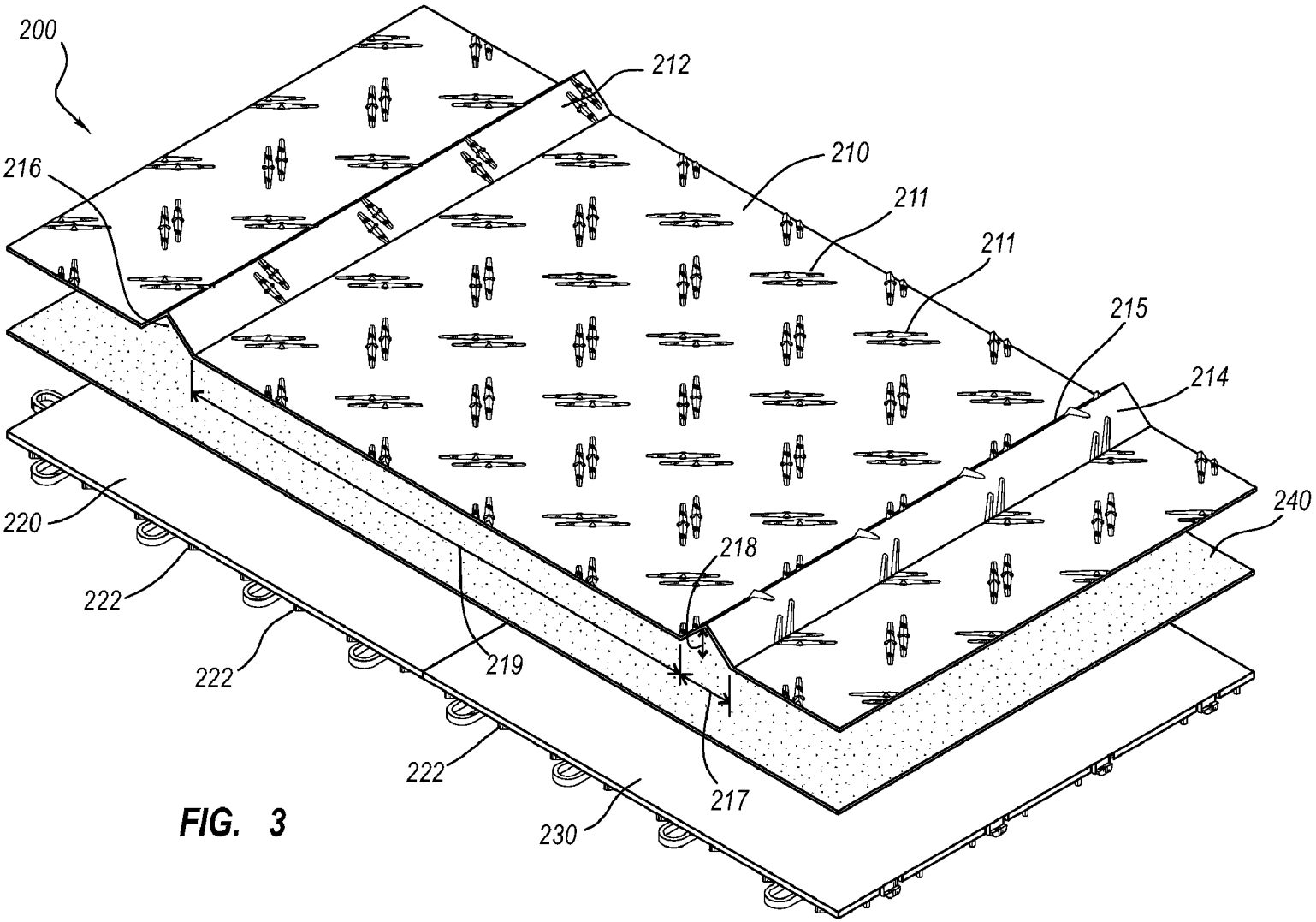
FIG. 3 is a perspective view of an exemplary modular-floor-locator section with a pad between a plate and a floor tile according to certain embodiments.

FIG. 3 is a perspective view of an exemplary modular-floor-locator section 200. Modular-floor-locator section 200 may include a plate 210 with locator raised surface areas 212 and 214. Plate 210 may also be referred to as a top surface. Plate 210 may be made of metal, plastic, wood, or any other suitable material. In some embodiments, plate 210 may be smooth. In other embodiments, plate 210 may include diamond-shaped protuberances 211. Plate 210 may also include other shapes of protuberances (e.g., circular, rectangular, etc.), indentions, or other designs for aesthetic or utilitarian purposes. The designs on plate 210 may match the designs on floor tiles in a modular floor where modular-floor-locator section 200 is to be installed.

As previously discussed, locator raised surface areas, such as locator raised surface areas 212 and 214, may assist a user in positioning a car, a truck, a motorcycle, or any other vehicle or object on modular-floor-locator section 200. Locator raised surface areas 212 and 214 may be any size, shape, or dimension. For example, locator raised surface areas 212 and 214 may be triangular raised surface areas with an apex formed at a right angle. The apex of locator raised surface areas 212 and 214 may also be an obtuse angle or an acute angle.

Locator raised surface areas 212 and 214 may be dimensioned such that a driver of a vehicle notices (e.g., feels a raised surface area or resistance against moving forward) when a tire of the vehicle contacts or starts rolling over locator raised surface area 212 or 214. As shown in FIG. 3, locator raised surface area 214 may have a width 217 and a height 218. In certain embodiments, width 217 may be approximately one and a half inches and height 218 may be approximately three-fourths of an inch. In other embodiments, width 217 may be narrower or wider and height 218 may be shorter or taller. Indeed, locator raised surface areas 212 and 214 may have various different height and width dimensions.

As shown in FIG. 3, locator raised surface areas 212 and 214 may be separated by a distance 219. According to certain embodiments, distance 219 may be approximately 15.75 inches. In other embodiments, distance 219 may be more or less than 15.75 inches. Locator raised surface areas 212 and 214 may be spaced any distance apart, including being side-by-side or being on opposite ends of modular-floor-locator section 200. In some embodiments, locator raised surface areas 212 and 214 may be spaced apart enough to allow a vehicle tire to rest between them.

Locator raised surface areas may be various shapes, sizes, and configurations. For example, locator raised surface areas 212 and 214 may span a width of plate 210, as FIG. 3 illustrates. In other embodiments, locator raised surface areas may span only a portion of the width of a plate or top surface (see FIG. 6). Locator raised surface areas may also be formed from a set of raised surface areas that span all or a portion of the width of a plate (see FIG. 8). In certain embodiments, locator raised surface areas may be positioned to span all or a portion of a length of a top surface. Locator raised surface areas may be wedge-shaped, rounded, squared, or any other shape. Furthermore, locator raised surface areas may define an open space, such as space 216 under locator raised surface area 212. In other embodiments, locator raised surface areas may be solid.

Modular-floor-locator section 200 may also have various different dimensions and configurations. For example, modular-floor-locator section 200 may be sized to fix exactly over two one-foot by one-foot modular-floor tiles (i.e., modular-floor-locator section 200 would be one foot wide and two feet long). Modular-floor-locator section 200 may have various other rectangular dimensions or may be squared (e.g., one-foot by one-foot, two-feet by two-feet, etc.). Modular-floor-locator section 200 may also be triangular, circular, trapezoidal, or any other shape or size.

As shown in FIG. 3, modular-floor-locator section 200 may include a pad 240 that fits between plate 210 and tiles 220 and 230. Pad 240 may be a rubber pad or may be any other material. In some embodiments, pad 240 may help to prevent plate 210 from slipping forward when a vehicle pulls onto modular-floor-locator section 200. In certain embodiments, modular-floor-locator section 200 does not include pad 240, and plate 210 may rest directly on floor tiles 220 and 230. Plate 210 may also be attached to floor tiles 220 and 230 with an adhesive or any other type of attachment mechanism or member. In certain embodiments, plate 210, pad 240, and floor tiles 220 and 230 may include holes that allow air or liquids to pass through plate 210 to a sub-floor underneath modular-floor-locator section 200 (see FIG. 4).

Floor tiles 220 and 230 may be substantially smooth on top to facilitate gripping with pad 240. When floor tiles 220 and 230 are smooth on top, they may allow pad 240 to grip a substantial amount of the top surface area of tiles 220 and 230 to keep plate 210 from moving when a vehicle pulls onto plate 210. Floor tiles 220 and 230 may also include protuberances, indentions, or other designs. Also, as shown in FIG. 3, floor tiles 220 and 230 may include connecting members 222 that allow tiles 220 and 230 to attach to each other and attach to other floor tiles in a modular floor.

In some embodiments, each of floor tiles 220 and 230 may have the same dimensions as other tiles in a modular floor. In other embodiments, floor tiles 220 and 230 may be special modular-floor-locator section tiles that are thinner than other modular-floor tiles. For example, a typical floor tile in a modular floor may be three-fourths of an inch thick. Floor tiles 220 and 230 may be thinner than three-fourths of an inch so that the total thickness of plate 210, pad 240, and floor tile 220 or 230 may also be three-fourths of an inch. In other words, modular-floor-locator section 200 may be the same thickness as adjacent tiles in a modular floor, thereby allowing modular-floor-locator section 200 to be flush with adjacent tiles. In certain embodiments, plate 210 may be approximately one-eighth of an inch thick, pad 240 may be approximately one-eighth of an inch thick, and floor tiles 220 and 230 may be approximately one-half of an inch thick. Various other thicknesses for plate 210, pad 240, tile 220, and tile 230 fall within embodiments of the instant disclosure. In some embodiments, plate 210 and pad 240, or just plate 210, may be placed directly on top of a floor tile that is approximately three-fourths of an inch thick (e.g., the same dimensions as other modular floor tiles in the modular floor). In these embodiments, modular-floor-locator section 200 may not be flush with adjacent floor tiles.

Figure 4:
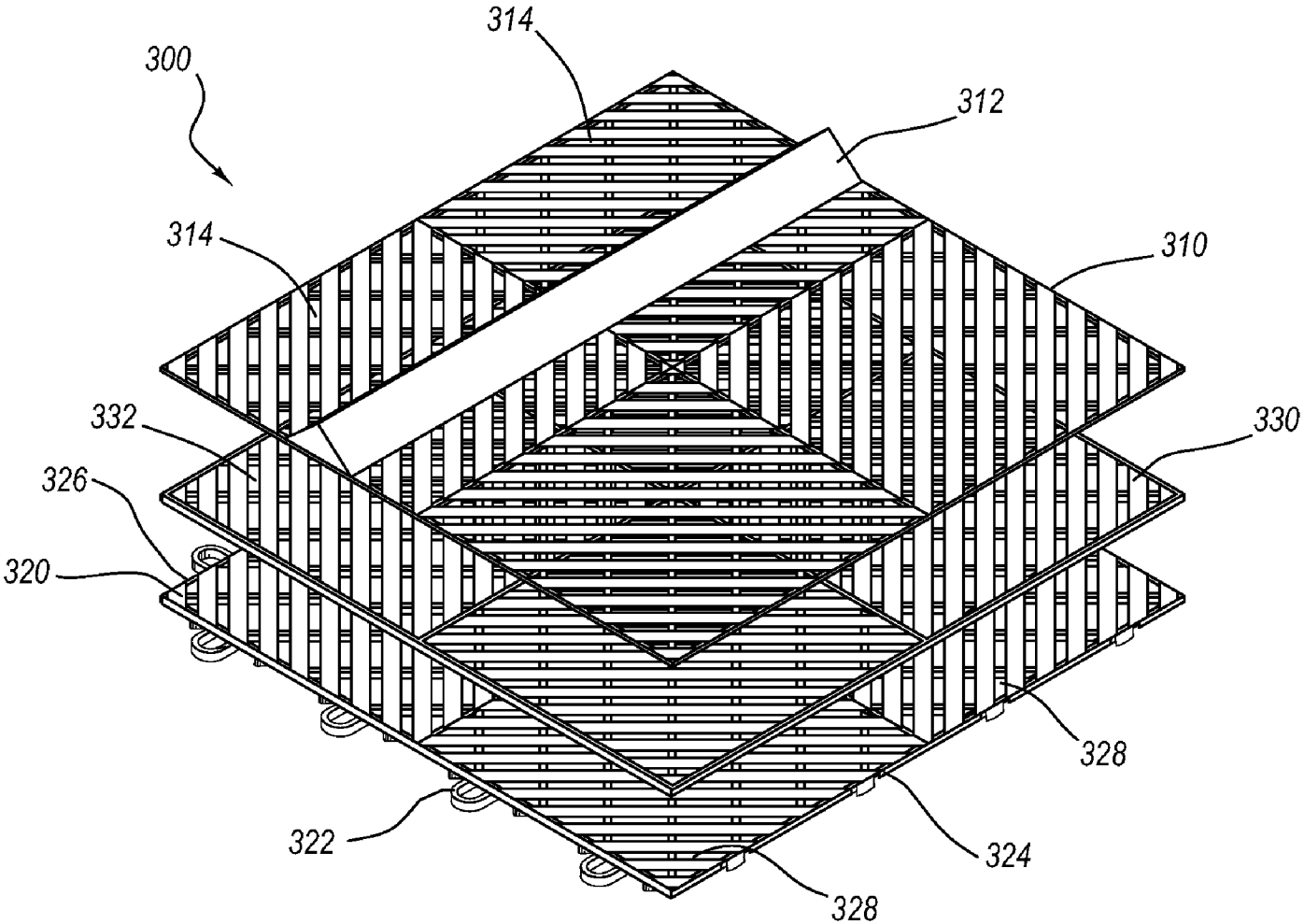
FIG. 4 is a perspective view of an exemplary single tile modular-floor-locator section according to certain embodiments.

FIG. 4 is a perspective view of an exemplary modular-floor-locator section 300 with a top surface 310, a floor tile 320, and a pad 330. Modular-floor-locator section 300 may include a single locator raised surface area 312 formed in top surface 310. As shown in FIG. 4, top surface 310 may be dimensioned to fit over a single floor tile 320 instead of being dimensioned to fit over two tiles, as with modular-floor-locator section 200.

Floor tile 320 may include connecting members 322 to allow modular-floor-locator section 300 to be attached to other floor tiles or other modular-floor-locator sections. The configuration of modular-floor-locator section 300 (i.e., a single locator raised surface area on a top surface that fits over a single floor tile) provides flexibility in the spacing and arrangement of locator raised surface areas. For example, a second modular-floor-locator section (not shown) may be attached to a right side 324 of modular-floor-locator section 300 such that locator raised surface areas on the modular-floor-locator sections are spaced like the locator raised surface areas in modular-floor-locator section 200. Alternatively, a second modular-floor-locator section may be attached to a left side 326 of modular-floor-locator section 300 such that locator raised surface areas in the modular-floor-locator sections are closer together. Also, one or more floor tiles may be attached between two modular-floor-locator sections to provide extra spacing between locator raised surface areas.

Floor tile 320 may include openings 328, pad 330 may include openings 332, and top surface 310 may include openings 314. Openings 314, 328, and 332 may allow air, liquids, or other debris to fall through modular-floor-locator section 300 to a sub-floor below modular-floor-locator section 300. Thus, openings 314, 328, and 332 may allow air flow and liquid drainage through modular-floor-locator section 300, which may be desirable for some modular flooring applications (e.g., a modular floor in a repair shop).

Figure 5:
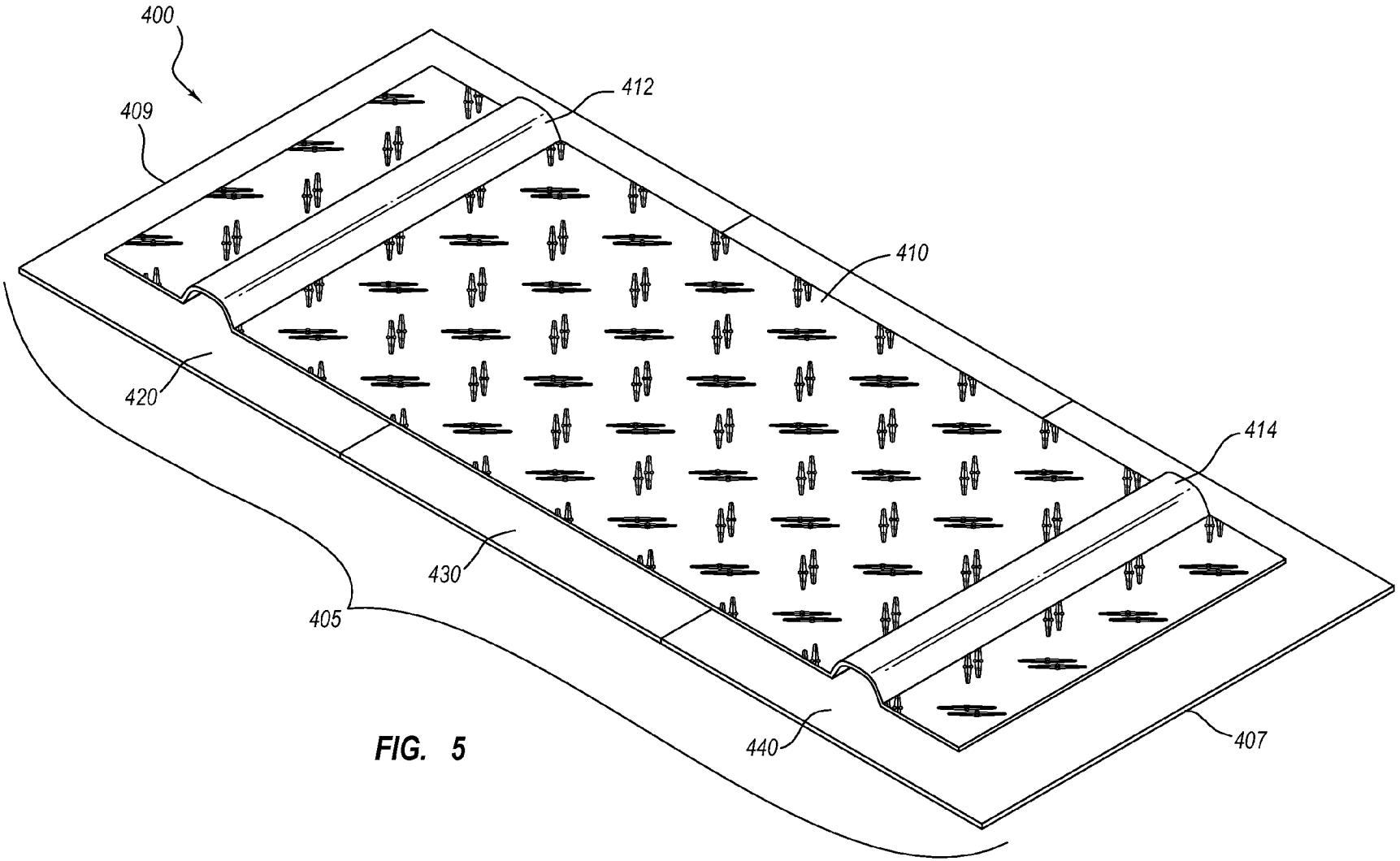
FIG. 5 is a perspective view of an exemplary modular-floor-locator section according to certain embodiments.

FIG. 5 illustrates a modular-floor-locator section 400 with a base section 405 that is larger than a top surface 410. Base section 405 may include tiles 420, 430, and 440. As illustrated in FIG. 5, base section 405 may be wider and longer than top surface 410. In some embodiments, base section 405 may be narrower and/or shorter than top surface 410. When top surface 410 is smaller than base section 405, a user may have additional flexibility in positioning top surface 410. For example, top surface 410 may be positioned toward a right side 407 of base section 405 as illustrated in FIG. 5. Alternatively, top surface 410 may be positioned toward a left side 409 of base section 405.

As illustrated in FIG. 5, modular-floor-locator section 400 does not include connecting members. Thus, tiles 420, 430, and 440 may sit next to each other without being attached. In some embodiments, tiles 420, 430, and 440 may be attached to a sub-floor using epoxy, tape, or any other adhesive.

FIG. 5 further shows an example of a modular-floor-locator section that does not include a pad. Top surface 410 may rest directly on floor tiles 420, 430, and 440. In some embodiments, top surface 410 may be attached to floor tiles 420, 430, and 440 using tape, epoxy, or any other adhesive. For example, top surface 410 may include an adhesive on a bottom portion, and the adhesive may be covered by a peel-away paper cover. A user may pull the peel-away paper cover off the adhesive and then attach top surface 410 to floor tiles 420, 430, and 440. Top surface 410 may also include an attachment member that may attach to a floor tile. Also, it is noted that locator raised surface areas 412 and 414 are examples of rounded locator raised surface areas.

Figure 6:
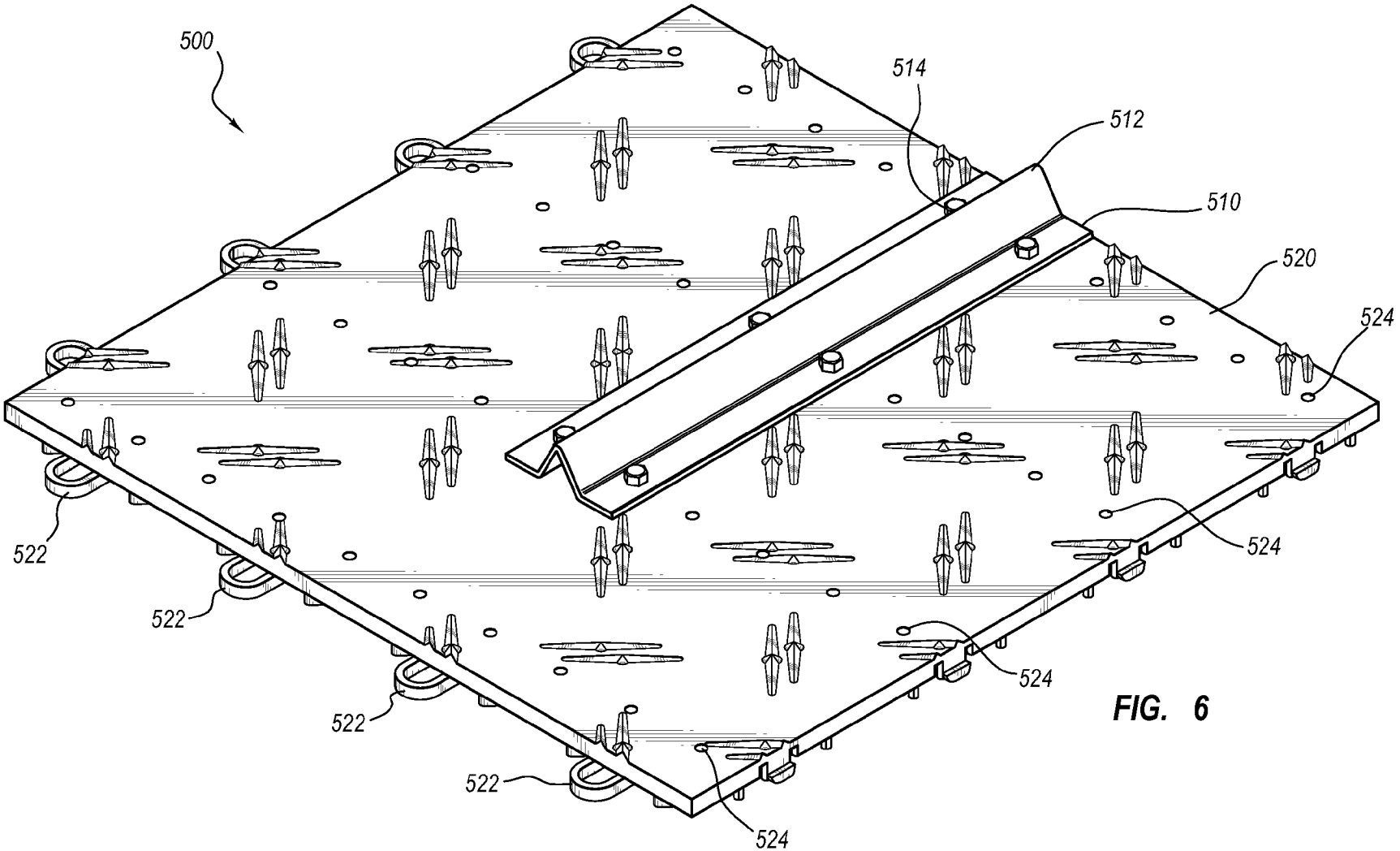
FIG. 6 is a perspective view of an exemplary modular-floor-locator section according to certain embodiments.

A top surface, such as top surface 410, may be a plate, an attachment, a layer, a sheet, etc. For example, a top surface may be a top portion of a floor tile, a top area or region of a floor tile, a floor tile cover, an obverse side of a floor tile, a sheet, a panel, or any other layer, surface, or material that may include a locator raised surface area. A top surface may be made of metal, plastic, wood, or any other suitable material. FIG. 6 shows an attachment as a top surface. FIGS. 7-11 show top surfaces that are top portions or layers of a floor tile.

FIG. 6 illustrates a perspective view of a modular-floor-locator section 500. Modular-floor-locator section 500 may include a floor tile 520 and a locator attachment 510. Locator attachment 510 may also be referred to as a top surface. Locator attachment 510 may include a locator raised surface area 512 and may be attached to floor tile 520 with bolts 514. Other types of attachment members may also connect locator attachment 510 to floor tile 520.

Bolts 514 pass through holes 524 in floor tile 520 to attach locator wedge 510 to floor tile 520. As shown in FIG. 6, floor tile 520 may include several rows of holes 524, which allows locator 510 to be attached to floor tile 520 in various different positions. Also, FIG. 6 shows that locator attachment 510 does not span the entire width of floor tile 520. In some embodiments, a locator attachment may be shorter or longer than locator attachment 512. Furthermore, more than one locator attachment may be affixed to floor tile 520. As with other floor tiles, floor tile 520 may include connecting members 522.

Figure 7:
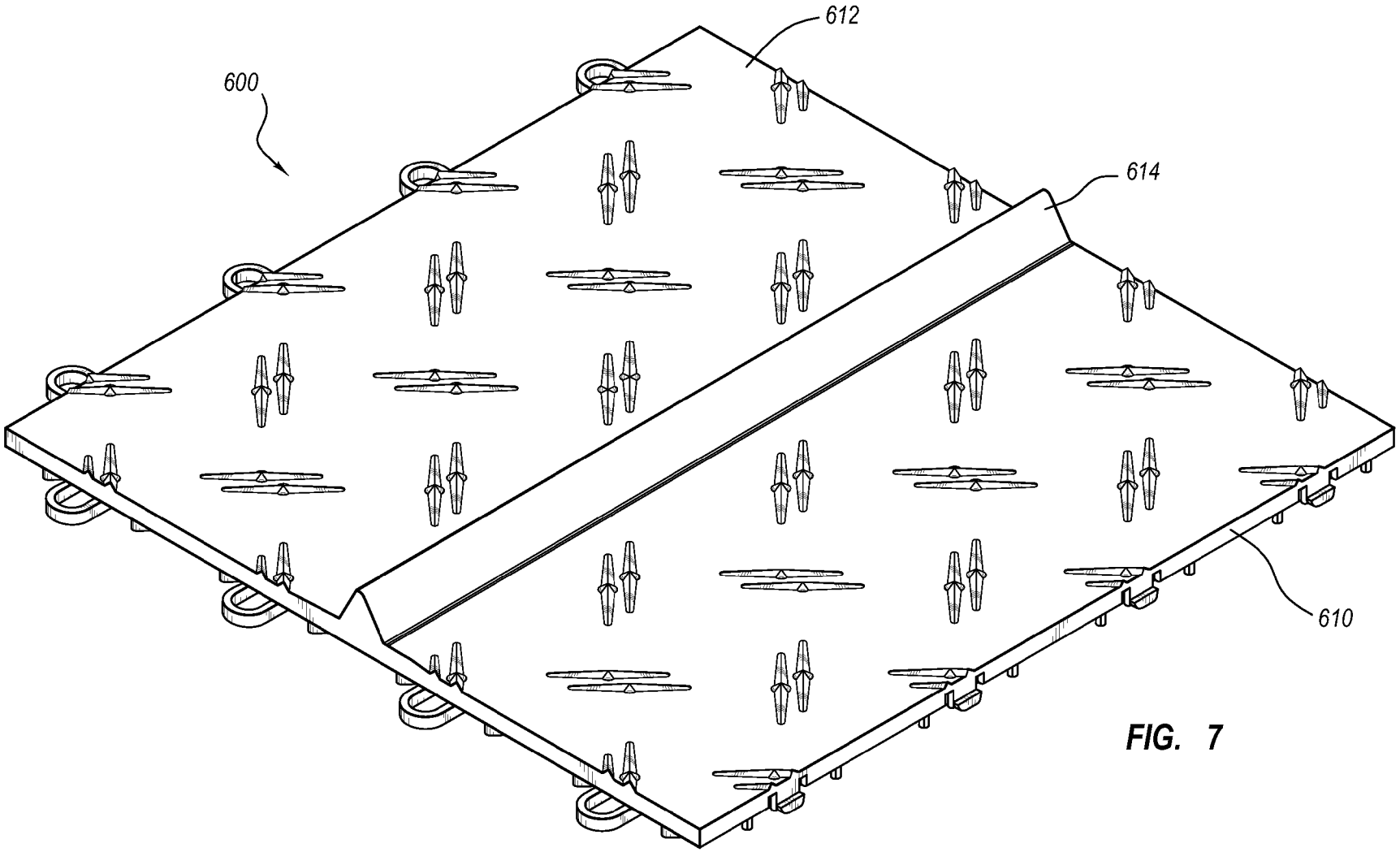
FIG. 7 is a perspective view of an exemplary modular-floor-locator section with a locator raised surface area extending from a top surface of a floor tile according to certain embodiments.
Figure 8:
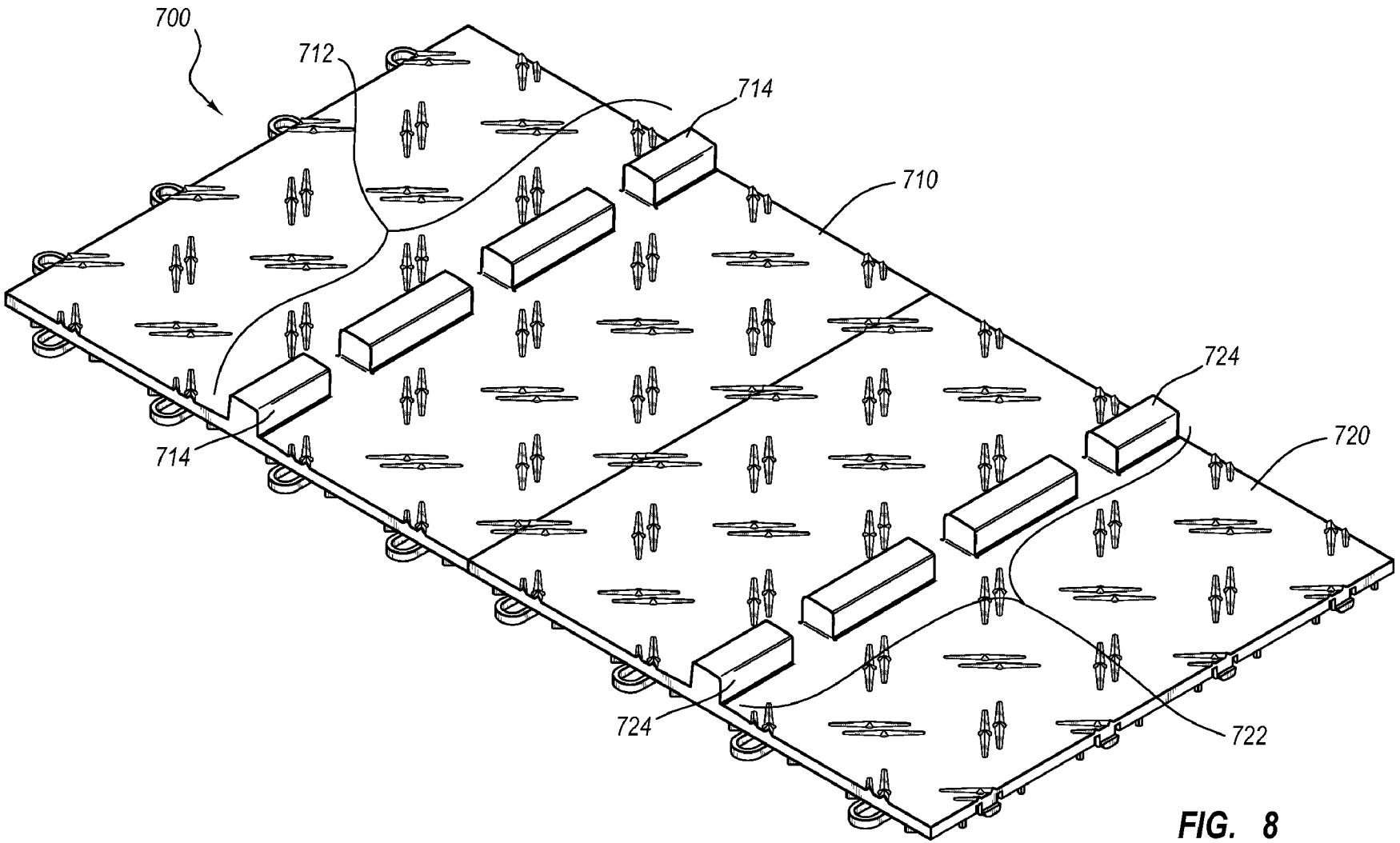
FIG. 8 is a perspective view of an exemplary modular-floor-locator section with a plurality of protrusions forming a locator raised surface area according to certain embodiments.

FIG. 7 is a perspective view of a modular-floor-locator section 600 with a floor tile 610 comprising a top surface 612. A locator raised surface area 614 may be formed in top surface 612. Thus, as previously mentioned, a top surface of a modular-floor-locator section, such as top surface 612, may a top portion of a floor tile. Accordingly, in some embodiments, a separate plate or attachment may not be needed for use as a top surface. Locator raised surface area 614 may be formed in any portion of top surface 612 and may be any size suitable for use as a guide in locating a vehicle or object on a modular floor. In some embodiments, locator raised surface area 612 may comprise multiple raised surface areas formed in a modular floor tile or a top plate. FIG. 8 shows an example of a locator raised surface area comprising multiple protrusions.

FIG. 8 is a perspective view of an exemplary modular-floor-locator section 700. Modular-floor-locator section 700 may include floor tiles 710 and 720, and locator raised surface areas 712 and 722 may be formed in floor tiles 710 and 720. Locator raised surface area 712 may comprise a plurality of protrusions 714, and locator raised surface area 722 may include a plurality of protrusions 724.

Figure 9:
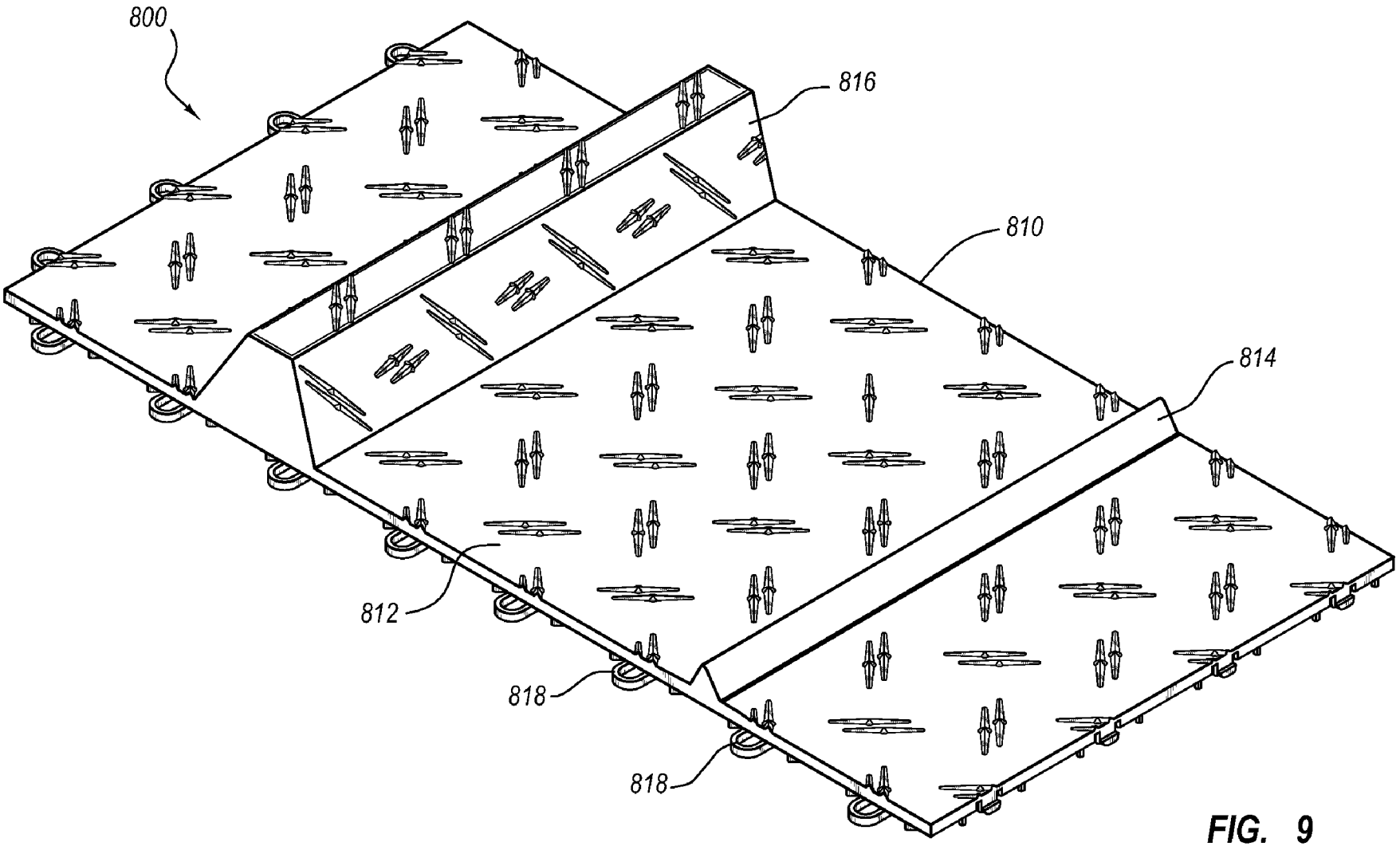
FIG. 9 is a perspective view of an exemplary modular-floor-locator section with a tire chock according to certain embodiments.

FIG. 9 is a perspective view of an exemplary modular-floor-locator section 800. Modular-floor-locator section 800 may include a single tile 810 with two locator raised surface areas 814 and 816 formed in a top surface 812. Locator raised surface area 814 may be smaller than locator raised surface area 816. Locator raised surface area 816 may be a chock dimensioned to inhibit a vehicle's movement past or over locator raised surface area 816. FIG. 9 also shows that floor tile 810 includes connecting members 818.

Figure 10:
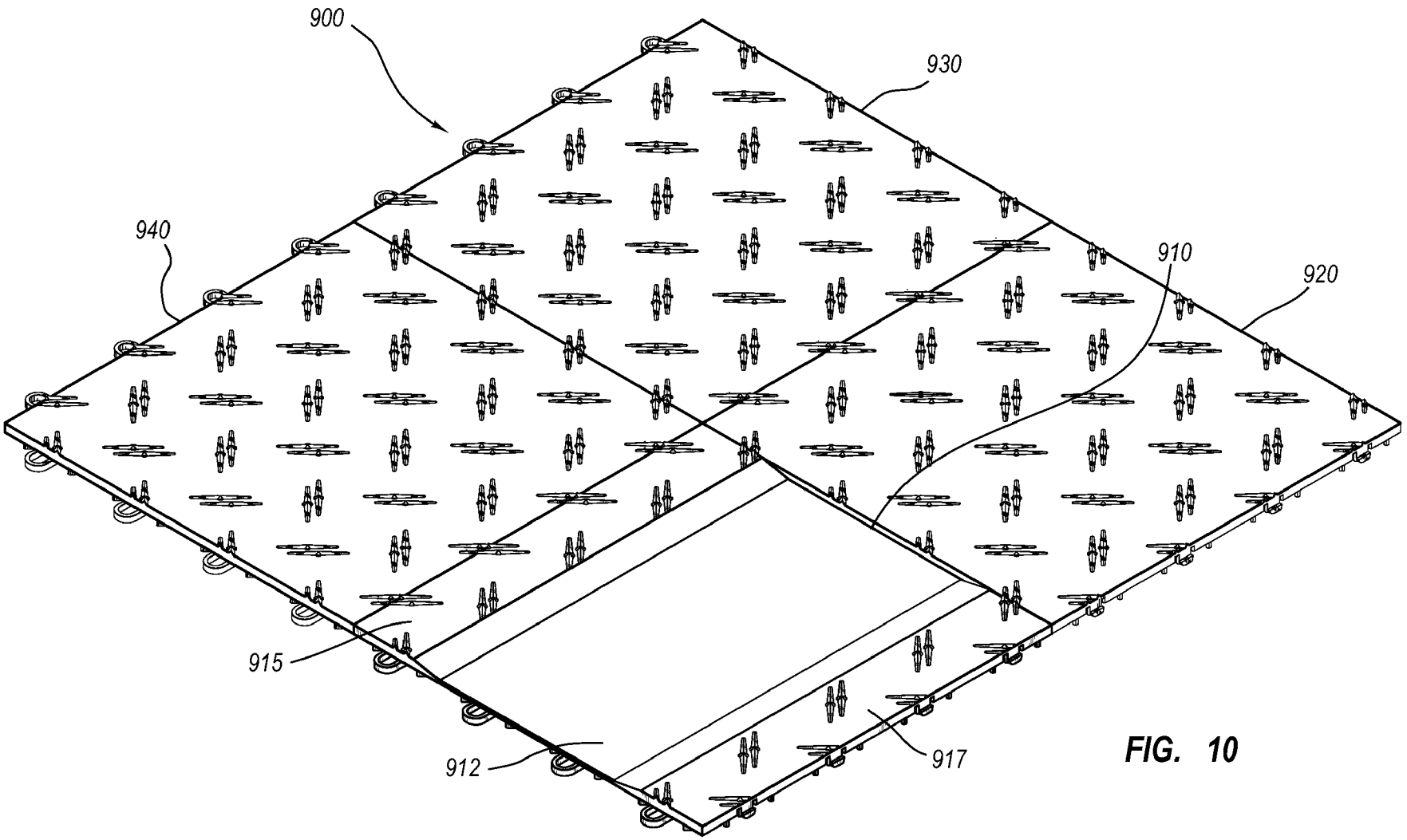
FIG. 10 is a perspective view of an exemplary modular-floor-locator section with a recessed top surface according to certain embodiments.

FIG. 10 is a perspective view of an exemplary modular floor 900 with floor tiles 920, 930, 940, and a modular-floor-locator section 910. Modular-floor-locator section 910 may include a top surface 912, and locator raised surface areas 915 and 917 may be formed in and part of top surface 912. Locator raised surface areas 915 and 917 may include flat top portions that are coplanar with top portions of adjacent tiles, such as floor tiles 920 and 940. Thus, after a tire rolls over locator raised surface area 917, the tire may dip down into the recessed portion of modular-floor-locator section 910 before hitting locator raised surface area 915. Accordingly, a driver may not know that the tire is in contact with locator raised surface area 917 until the tire starts to roll into the recessed portion of modular-floor-locator section 910.

Figure 11:
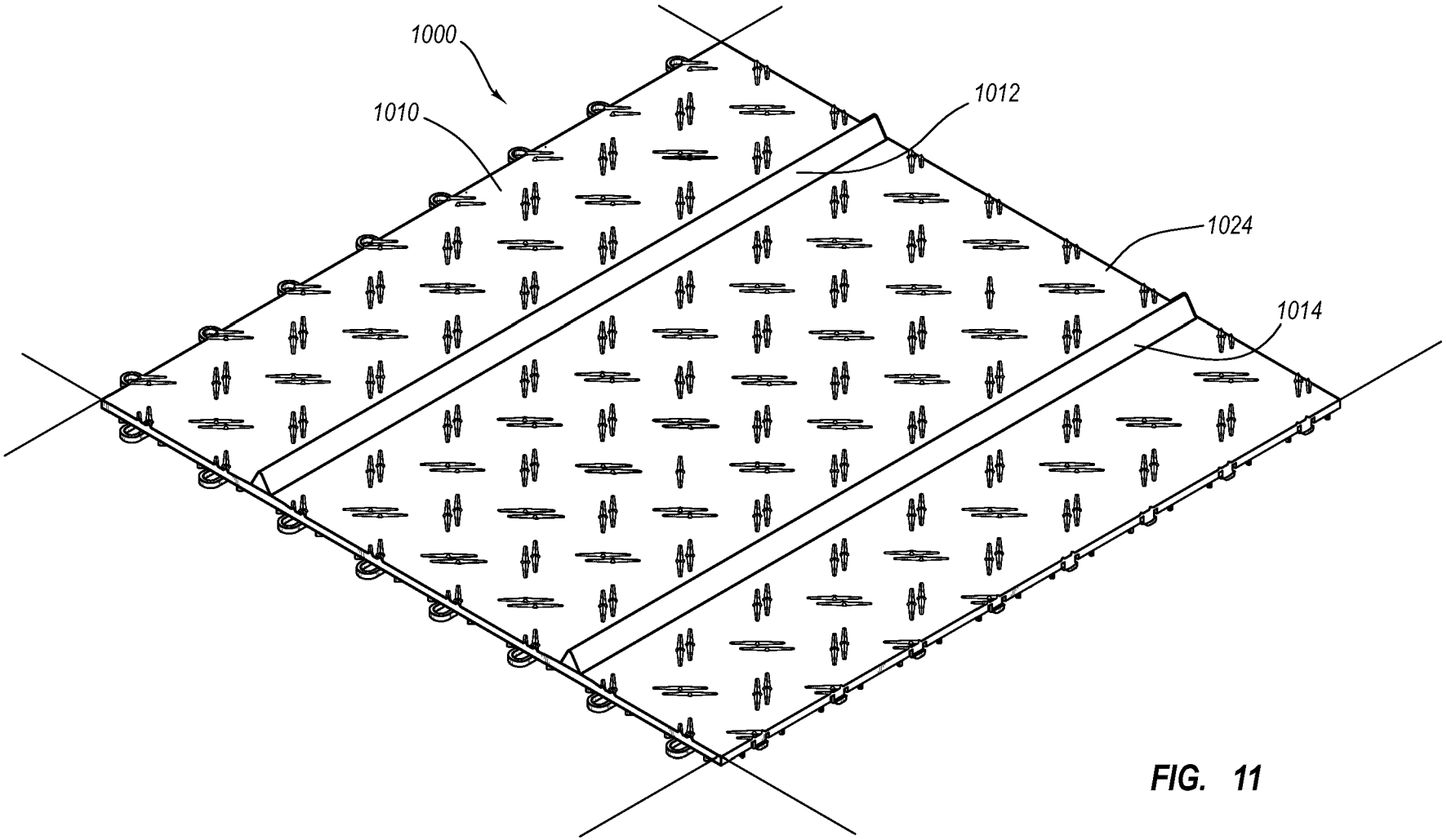
FIG. 11 is a perspective view of an exemplary extended modular-floor-locator section according to certain embodiments.

FIG. 11 is a perspective view of a modular-floor-locator section 1000. Modular-floor-locator section 1000 may include raised surface areas 1012 and 1014. In some embodiments, modular-floor-locator section 1000 may be approximately the same size as four floor tiles, and thus may be used to replace four floor tiles in a modular floor. Modular-floor-locator section 1000 may be used with dual-wheeled vehicles, such as trucks or trailers. A user may achieve the same configuration as modular-floor-locator section 1000 by placing two modular-floor-locator sections 200 side by side.

As used throughout the claims and specification, the term "modular" refers to objects of regular or standardized units or dimensions, as to provide multiple components for assembly of flexible arrangements and uses. The words "including" and "having," as used in the specification, including the claims, have the same meaning as the word "comprising."

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive, and that reference be made to the appended claims and their equivalents for determining the scope of the instant disclosure. In addition, for ease of use, the words "including" and "having," as used in the specification and claims, are interchangeable with and have the same meaning as the word "comprising."

What is claimed is:

1. A modular-floor apparatus comprising:

a modular-floor-locator section to be combined with a plurality of modular-floor tiles to form a flooring surface, the modular-floor-locator section comprising:

a top surface;

a first locator raised surface area formed in the top surface, the first locator raised surface area being dimensioned to guide positioning of an object on the top surface;

wherein the modular-floor-locator section comprises a first tile;

the top surface comprises a plate, the plate being positioned above the first tile;

wherein the modular-floor-locator section comprises a second tile attached to the first tile, the second tile being positioned under the plate;

wherein the modular-floor-locator section comprises a second locator raised surface area formed in the plate;

the second locator raised surface area is positioned over the second tile;

the first locator raised surface area is positioned over the first tile.

2. A modular-floor apparatus comprising:

a modular-floor-locator section to be combined with a plurality of modular-floor tiles to form a flooring surface, the modular-floor-locator section comprising:

a top surface;

a first locator raised surface area formed in the top surface, the first locator raised surface area being dimensioned to guide positioning of an object on the top surface;

wherein the modular-floor-locator section comprises a first tile;

the top surface comprises a plate, the plate being positioned above the first tile;

wherein the modular-floor-locator section comprises a pad situated between the plate and the first tile.

3. A modular-floor apparatus comprising:

a modular-floor-locator section to be combined with a plurality of modular-floor tiles to form a flooring surface, the modular-floor-locator section comprising:

a top surface;

a first locator raised surface area formed in the top surface, the first locator raised surface area being dimensioned to guide positioning of an object on the top surface;

wherein the modular-floor-locator section comprises a first tile;

the top surface comprises a plate, the plate being positioned above the first tile;

wherein the modular-floor-locator section comprises a pad situated between the plate and the first tile;

wherein the first tile comprises a plastic material, the plate comprises a metal material, and the pad comprises a rubber material.

4. A modular-floor apparatus comprising:

a modular-floor-locator section, the modular-floor-locator section comprising:

a connecting member removably attachable to a modular-floor tile;

first tile;

a first locator raised surface area formed in the first tile;

wherein the modular-floor-locator section comprises:

a second tile attached to the first file;

a second locator raised surface area formed in the second tile, the first and second locator raised surface areas being spaced to allow a vehicle tire to rest between the first and second locator raised surface areas.

* * * * *